US005119965A

United States Patent [19]

Arduca et al.

[11] Patent Number: 5,119,965

[45] Date of Patent: Jun. 9, 1992

[54] DRESSING CAPSULE FOR BOTTLE

[76] Inventors: Anthony Arduca, 3 Madeline Court, Avondale Heights, Victoria 3034; Joseph Arduca, 14 Brees Road, East Keilor, Victoria 3033, both of Australia

[21] Appl. No.: 702,658

[22] Filed: May 17, 1991

[30] Foreign Application Priority Data

Dec. 20, 1990 [AU] Australia ..... PK4009

[51] Int. Cl.[5] ..... B65D 51/20

[52] U.S. Cl. ..... 215/251; 215/253; 220/257

[58] Field of Search ..... 215/251, 253; 220/257, 220/266

[56] References Cited

U.S. PATENT DOCUMENTS

| | | | |
|---|---|---|---|
| 518,277 | 4/1894 | Robinson | 215/251 |
| 1,029,738 | 6/1912 | Baruch | 215/251 |
| 1,481,035 | 1/1924 | Stattmann | 215/251 |
| 1,482,823 | 2/1924 | Stattmann | 215/251 |
| 2,124,874 | 7/1938 | Conner et al. | 215/251 |
| 2,151,826 | 3/1939 | Anderson | 215/251 |
| 4,527,701 | 7/1985 | Schaubeck | 215/220 |
| 4,669,620 | 6/1987 | Coifman | 215/220 |

*Primary Examiner*—Stephen Marcus
*Assistant Examiner*—Nova Stucker
*Attorney, Agent, or Firm*—Andrus, Seales, Starke & Sawall

[57] ABSTRACT

This invention relates to a capsule for the top of a bottle which can be opened in a simple movement. The capsule comprises an upper portion connected to a skirt by a frangible connecting means. The capsule fits over the top of the neck of the bottle and once in position is opened by movement of the skirt towards the base of the bottle to break the frangible connecting means. The frangible connecting means may be formed thicker at one point so that the downward opening movement will leave an upper portion and the skirt substantially separated but connected by a thin bridging element.

17 Claims, 1 Drawing Sheet

DRESSING CAPSULE FOR BOTTLE

Figure 1:
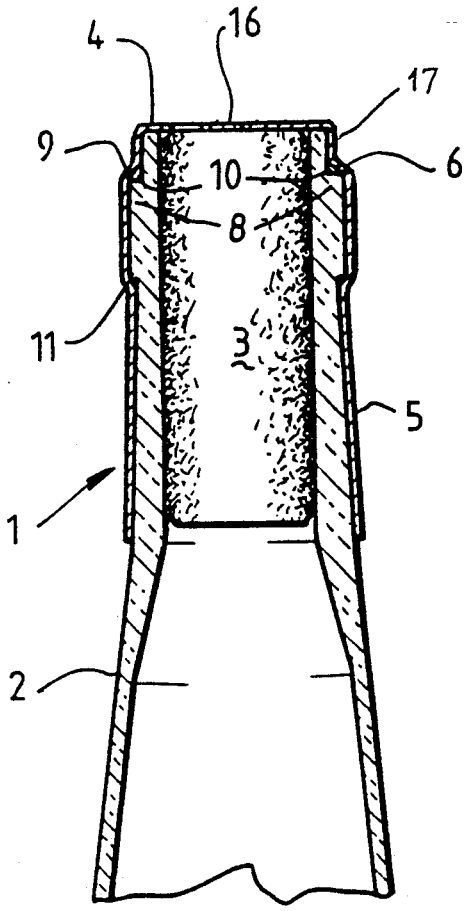

This invention relates to a capsule for the top of a bottle and in particular to a capsule which can be opened in a simple movement.

In a bottle such as those used in the wine industry, a stopper or cork is usually inserted into the opening of the bottle to retain the contents and protect them from the surrounding atmosphere. The cork does not generally protrude from the neck of the bottle and is tightly held in place by frictional forces created by compression of the cork.

To improve the aesthetics of the bottle, a capsule is placed over the neck of the bottle and secured in place thus concealing the cork. However to gain access to the cork and hence the contents of the bottle, it is necessary to remove at least that portion of the capsule in proximity to the bottle opening and use a corkscrew to remove the cork.

Generally there are two types of capsules currently being used.

One type of capsule is made from a sheet of soft tearable metal drawn into a cup shape. The metal is predominantly lead, with a very thin layer of another metal such as tin coating the surfaces. To access the cork the capsule is either torn from the neck of the bottle or cut around the perimeter at the top with a knife and the top removed. Alternatively the corkscrew can be inserted through the metal capsule and the cork pulled through the capsule tearing the metal. Although a layer of tin prevents exposure of the lead to the bottle surface and to the hands of the person handling the bottle, the presence of lead nevertheless presents an associated health and environmental problem. Therefore, there is a need to reduce or eliminate the use of lead for such applications. Unfortunately the cost of alternative metals with the required properties seriously limits their use and acceptance in this field.

Another type of capsule is made from sheet polymeric material which is applied to the neck of a bottle in a heated state and upon cooling conforms to the neck. Access is gained to the cork by simply cutting the top or the entire capsule from the bottle. As these polymeric material cannot successfully be recycled, these spent capsules also create a disposal and environmental problem.

Furthermore, polymeric or plastic capsules are not as aesthetically acceptable as metal capsules and have become associated in the minds of the public with a lesser quality bottle product.

Therefore, it is an object of the present invention to provide a capsule which avoids at least one of the problems of the prior art.

In accordance with the objectives the invention provides a capsule for the top of a bottle said capsule having an upper portion connected to a skirt by a frangible connecting means, said upper portion and skirt adapted to fit over the neck of the bottle and characterised in that movement of said skirt in the direction of the base of the bottle will substantially separate the upper portion of the capsule from the skirt at the connecting means.

The weakened connecting means may be a line of weakness in the capsule or it may be a line of perforations or cuts around the circumference of the capsule.

Bottles to which the capsules are applicable have a thickened rib adjacent the end of the neck and extending around the circumference of the neck to provide a mechanical keying means for the capsule.

The upper portion of the capsule is preferably shaped to fit the neck of the bottle above the rib and the skirt preferably has an internal diameter at least equivalent to the rib diameter to allow the capsule to fit over the rib. The skirt is preferably crimped to form a circumferential indent below the rib to secure the capsule in place.

When in place, there is preferably sufficient space within the skirt above the rib to allow the skirt to be moved a short distance down the neck of the bottle such that the connecting means is fractured and the upper portion of the skirt is substantially separated from the skirt.

To operate the capsule and expose the cork of the bottle, the handler need only move the skirt of the capsule sharply in the direction generally towards the base of the bottle and the upper portion of the capsule will substantially separate from the skirt. If the skirt and upper portion are totally separated the upper portion will generally pop from the top of the bottle or if less force has been applied to the skirt in the opening movement, then the upper will remain in place and can be simply lifted from the bottle.

However, the frangible connecting means may be produced such that the upper portion of the capsule and the skirt are not totally separated after the opening movement and may finally be connected by a thin connecting bridge. Preferably this is accomplished by producing one section of the frangible connecting means stronger than the remainder. In these circumstances the downward movement of the skirt will cause the upper portion of the capsule to flip off the top of the bottle and remain attached to the skirt. The invention also provides for a bottle with capsule attached.

Figure 2:
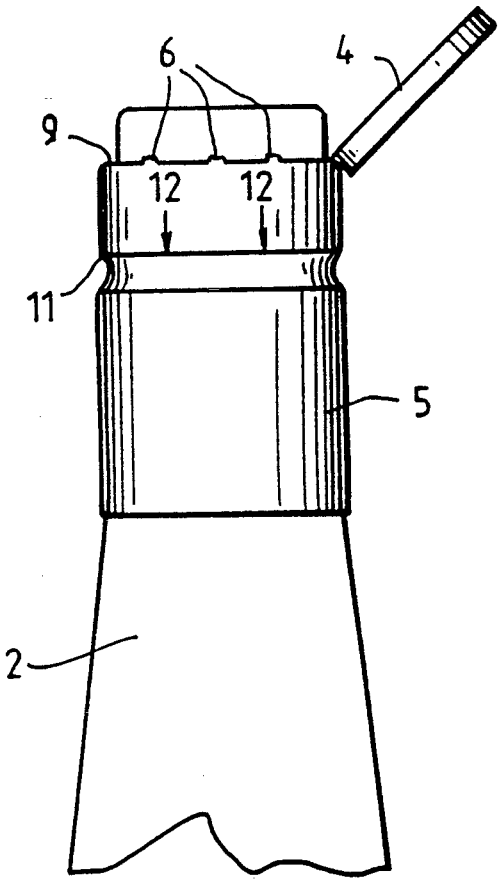
Figure 3:
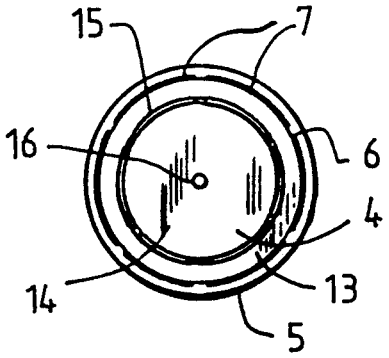
Figure 4:
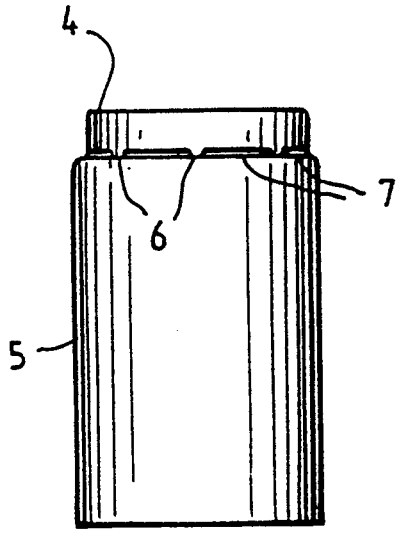

The foregoing and other features objects and advantages of the present invention will become more apparent from the following description of the preferred embodiment and accompanying drawings in which:

FIG. 1 is a sectional elevation view of a corked bottle with a capsule in place, FIG. 2 is the bottle of FIG. 1 showing the capsule in the opened position, FIG. 3 is a plan view of a capsule of the present invention and FIG. 4 is an elevational view of the capsule prior to being installed on a bottle neck.

Referring to the drawings, a capsule 1 is shown fitted to a bottle 2 covering the end of cork 3. The capsule is produced by deep drawing a ductile metal sheet, such as aluminium, using conventional methods well known to a person skilled in the art. The cork is compressed prior to being inserted into the neck of the bottle so that the cork is retained firmly in place in the bottle and prevents the contents from being removed.

The upper portion 4 of the capsule 1 which comprises a top surface 13 with a flange 17 extending around the periphery of the top surface 13 is connected to skirt 5 by a frangible connecting means illustrated in FIG. 4 as a plurality of connecting bridges 6. The connecting bridges 6 are formed in the capsule by cutting a series of slits 7 in the metal to form a line of bridges around the circumference of the capsule. The frangible connecting means in the capsule may be produced by other methods such as scoring a line in the capsule and hence leaving a weakened line of metal, or punching a line of perforations.

Bottles used in the wine industry are generally provided with a mechanical keying means, such as a rib 8, to secure a dress capsule to the neck of the bottle. When the capsule is in place the frangible connecting means is positioned above the rib 8 of the bottle so that the top of the skirt is above that region of the bottle. As shown in FIG. 1 the upper part of the skirt is narrower than the section corresponding to the rib of the bottle and forms a lip 9 on the top of the skirt. A space 10 is provided between the lip of the skirt and the ridge region 8 of the bottle to allow sufficient travel of the skirt in the direction of the base to fracture the weakened connecting means. The lip prevents further downward travel of the skirt past the rib 8 once the skirt and top portion are substantially separated.

To open the capsule the handler simply grasps the skirt of the capsule with his hand and moves the skirt in direction 12 towards the base of the bottle. It has been found that by adding a slight twist to the downward movement, it may be easier to fracture the frangible connecting means. Generally the disconnected upper portion of the capsule will remain on the bottle. However, if during opening, too much force is applied to the skirt by the handler, the upper portion of the capsule may fly off the top of the bottle and land inconveniently.

To prevent this, one section of the weakened connecting means may be formed so that it is slightly stronger than the rest of the connecting means and movement of the skirt in direction 12 will cause the upper portion of the capsule to remain attached to the skirt and flip off the top of the bottle. This can be achieved by making one connecting bridge wider than the rest. After opening the capsule, the upper portion of the capsule can then be removed from the skirt by working the remaining connecting bridge 6.

To prevent the capsule from slipping from the bottle when in place, the skirt is indented at a point 11 below the rib 8 of the bottle. This prevents upward movement of the capsule on the bottle neck.

As another optional feature of the present invention, the top surface 13 of the upper portion may also be provided with a weakened line 15 to provide a cutout portion 14 corresponding roughly with the opening of the bottle. Thus if the handler wishes to remove the cork without opening the capsule, a cork removing device such as a corkscrew can be inserted through the upper portion of the capsule and the cork and cutout portion 14 removed simultaneously. To assist inserting a corkscrew through the capsule a small hole 16 is provided in the top portion of the capsule.

The claims form part of the disclosure of the specification.

We claim:

1. A capsule for the top of a bottle, said capsule having an upper portion connected to a skirt by a frangible connecting means, said upper portion and said skirt being adapted to fit over the neck of the bottle, said upper portion of said capsule having a top surface which in use covers an opening in the neck of the bottle and a flange extending around the perimeter of said top surface in the direction of the skirt, said flange being connected to the skirt by the frangible connecting means, whereby said skirt can be substantially separated from said upper portion at the frangible connecting means by movement of said skirt in the direction of the base of the bottle.

2. The capsule in accordance with claim 1 wherein said upper portion of the capsule and said skirt remain connected by a bridging element after movement of said skirt in the direction of the base of the bottle.

3. The capsule in accordance with claim 2 wherein the frangible connecting means comprises a line of weakness formed in the capsule.

4. The capsule in accordance with claim 1, wherein said skirt is adapted to fit over a mechanical keying means on said bottle.

5. The capsule in accordance with claim 4 wherein the mechanical keying means comprises a rib formed below the top of the neck of the bottle and wherein said skirt is adapted to fit over the rib.

6. The capsule in accordance with claim 1 wherein the frangible connecting means comprises a line of weakness formed in the capsule.

7. The capsule in accordance with claim 1 wherein the frangible connecting means comprises a line of slits cut in the capsule.

8. The capsule in accordance with claim 4 wherein distance from the top surface of the upper portion to the frangible connecting means is less than the distance from the top of the bottle to the mechanical keying means of the bottle.

9. A capsule in accordance with claim 4 further characterised in that the top of said skirt is so formed that after an initial movement down the bottle to substantially separate the upper portion of said capsule and said skirt, the top of said skirt and said keying means cooperate to prevent further downward movement of said skirt.

10. The capsule in accordance with claim 9 wherein the top of said skirt has a lip which prevents downward movement of the top of the skirt past the mechanical keying means on the bottle.

11. The capsule in accordance with claim 1 wherein the top surface of the upper portion has frangible connecting means defining a region which corresponds substantially with the opening in the bottle.

12. The capsule in accordance with claim 11 wherein the region which corresponds substantially with the opening in the neck of the bottle can be removed from the upper portion of the capsule.

13. A bottle sealed with a cork having a mechanical keying means below the top of the neck and being fitted with a capsule in accordance with claim 1.

14. The capsule in accordance with claim 2 wherein the frangible connecting means comprises a line of slits cut in the capsule.

15. A bottle in accordance with claim 13, wherein the top of said skirt has a lip to prevent downward movement of said skirt past the mechanical keying means of said bottle when the top portion of said capsule and said skirt are substantially separated.

16. A bottle sealed with a cork having a mechanical keying means below the top of the neck and being fitted with a capsule in accordance with claim 2.

17. A bottle in accordance with claim 16, wherein the top of said skirt has a lip to prevent downward movement of said skirt past the mechanical keying means of said bottle when the top portion of said capsule and said skirt are substantially separated.

* * * * *